US005775820A

United States Patent [19]

Sugimoto et al.

[11] Patent Number: 5,775,820

[45] Date of Patent: Jul. 7, 1998

[54] THERMAL PRINTER HAVING A PRESS RELEASING MECHANISM

[75] Inventors: Kazuaki Sugimoto, Mishima; Izumi Matsushita, Suntoh-gun; Chiaki Yukawa, Mishima, all of Japan

[73] Assignee: Kabushiki Kaisha TEC, Shizuoka, Japan

[21] Appl. No.: 545,767

[22] PCT Filed: May 29, 1995

[86] PCT No.: PCT/JP95/01018

§ 371 Date: Apr. 8, 1996

§ 102(e) Date: Apr. 8, 1996

[87] PCT Pub. No.: WO95/32869

PCT Pub. Date: Dec. 7, 1995

[30] Foreign Application Priority Data

| | | | |
|---|---|---|---|
| May 31, 1994 | [JP] | Japan | 6-117900 |
| May 27, 1994 | [JP] | Japan | 6-115587 |
| Jun. 1, 1994 | [JP] | Japan | 6-119445 |

[51] Int. Cl.[6] ..... B41J 2/315

[52] U.S. Cl. ..... 400/120.16; 400/120.17; 347/197; 347/198

[58] Field of Search ..... 400/120.01, 120.16, 400/120.17; 347/197, 198

[56] References Cited

U.S. PATENT DOCUMENTS

| | | | |
|---|---|---|---|
| 4,769,103 | 9/1988 | Koike et al. . | |
| 5,051,009 | 9/1991 | Sugiura et al. | 400/120.16 |
| 5,064,300 | 11/1991 | Kashiwaba | 400/120.16 |
| 5,065,002 | 11/1991 | Tashiro et al. . | |
| 5,071,266 | 12/1991 | Harada et al. | 400/120.17 |
| 5,085,533 | 2/1992 | Kitahara et al. . | |
| 5,106,213 | 4/1992 | Martinez et al. | 400/120.16 |
| 5,156,547 | 10/1992 | Bailey . | |
| 5,174,667 | 12/1992 | Sugimoto et al. . | |
| 5,174,669 | 12/1992 | Fushimi et al. . | |
| 5,188,029 | 2/1993 | Sugimoto et al. . | |
| 5,266,966 | 11/1993 | Fushimi et al. . | |
| 5,378,071 | 1/1995 | Uehara | 400/120.16 |
| 5,401,352 | 3/1995 | Matsushita et al. . | |

FOREIGN PATENT DOCUMENTS

| | | |
|---|---|---|
| 0 345 079 | 12/1989 | European Pat. Off. . |
| 0 479 165 | 4/1992 | European Pat. Off. . |
| 42 19 798 | 12/1993 | Germany . |
| 60-240473 | 11/1985 | Japan . |
| 2-178059 | 7/1990 | Japan . |
| 6-979 | 1/1994 | Japan . |

OTHER PUBLICATIONS

Patent Abstracts of Japan, vol. 13, No. 177 (M-818) [3525], Apr. 26, 1989, JP-A-01-008055, Jan. 12, 1989.

Patent Abstracts of Japan, vol. 14, No. 152 (M-953) [4095], Mar. 23, 1990, JP-A-02-014176, Jan. 18, 1990.

*Primary Examiner*—John S. Hilten

*Attorney, Agent, or Firm*—Oblon, Spivak, McClelland, Maier & Neustadt, P.C.

[57] ABSTRACT

The present invention is provided with a head pressing mechanism for pressing a thermal head against a platen, a paper feeding mechanism for feeding print paper between the thermal head and the platen in a secondary scanning direction, a ribbon transporting mechanism for transporting an ink ribbon between the thermal head and the platen in the secondary scanning direction, and a press releasing mechanism for causing the thermal head to move away from the platen against a pressing force of the head pressing mechanism. The press releasing mechanism slides a rod of a solenoid, elongated in the secondary scanning direction, at the position opposing to the rear surface of the thermal head in the secondary scanning direction. A lever link transforms this sliding action into the departing action of the thermal head from the platen. The solenoid and the thermal head are longitudinally aligned substantially in parallel to each other, and the area occupied by the thermal head and the solenoid is reduced, thereby resulting in a thermal printer which is compact as a whole.

13 Claims, 6 Drawing Sheets

THERMAL PRINTER HAVING A PRESS RELEASING MECHANISM

TECHNICAL FIELD

The present invention relates to a thermal printer which carries out printing by thermally transferring ink of an ink ribbon to print paper using a thermal head.

BACKGROUND ART

An image printing mechanism of a thermal printer comprises a thermal head including a plurality of heating elements arranged in rows, and a platen against which the heating elements of the thermal head are detachably pressed. The thermal head is pressed against the platen by a head pressing mechanism which presses the thermal head against the platen. Such a thermal printer is usually provided with a paper feeding mechanism for feeding print paper between the thermal head and the platen, and a ribbon transporting mechanism for transporting an ink ribbon between the thermal printer and print paper. Where the thermal printer is assembled as a line printer, the heating elements of the thermal head are arranged in the direction of primary scanning while the print paper and the ink ribbon are fed in the direction of secondary scanning by means of the paper feeding mechanism and the ribbon transporting mechanism. In the thermal printer having such a construction, the paper feeding mechanism feeds the print paper in synchronism with the feeding of the ink ribbon by the ribbon transporting mechanism. Further, the heating elements of the thermal head are selectively heated in synchronism with these feeding mechanisms. As a result, ink from the ink ribbon is selectively transferred to the print paper, so that dot-matrix images are formed.

Synchronization in feeding action between the print paper and the ink ribbon connotes that the ink ribbon is transported in accordance with the amount of travel of the print paper. However, in some cases, the print paper is fed without forming an image. The feeding of the ink ribbon in this case results in wastage of the ink ribbon. To prevent this, some printers are provided with a press releasing mechanism which drives the thermal head using a solenoid so as to move it away from the platen. The print paper is fed while the thermal head is separated from the platen, whereby only the print paper is fed without moving the ink ribbon. More specifically, this type of thermal printer is provided with a solenoid whose rod advances or recedes when energized. The solenoid is disposed with its rod facing in the direction orthogonal to the direction of the movement of the thermal head, and the rod is linked to a movable end of the thermal head. With this arrangement, the energizing of the solenoid causes the rod to advance or recede, so that the other end of the thermal head is pulled in the direction opposite to the platen. As a result, the platen moves away from the thermal head.

Drawbacks in the prior art will now be explained. The solenoid is elongated in the direction in which the rod advances or recedes. For this reason, the space occupied by the solenoid and the thermal head is L-shaped, and the area of that occupied space becomes increased. This results in a large-sized thermal printer. Particularly, the solenoid interrupts a transporting path for the ink ribbon, and this significantly restricts the degree of freedom with which the ink ribbon transporting path can be arranged.

Another problem of the prior art is that the thermal printer becomes large since a large-sized solenoid becomes necessary to provide large drive torque for drawing the thermal head against the pressing force of the head pressing mechanism.

A further problem of the prior art is that the rod of the solenoid must be connected to the thermal head after attachment of the solenoid to the printer when the press releasing mechanism is used. This makes the assembling work of the printer complicated.

An object of the present invention is to provide a compact thermal printer.

Another object of the present invention is to provide a thermal printer which is easy to be assembled.

A further object of the present invention is to provide a thermal printer which facilitates the setting of print paper.

DISCLOSURE OF THE INVENTION

A thermal printer comprises: a platen; a thermal head which is pressed against or moves away from the platen, the thermal head including a plurality of heating elements arranged at a part thereof which comes into contact with the platen; a head pressing mechanism which presses the thermal head against the platen; a paper feeding mechanism for feeding print paper between the thermal head and the platen in the direction of secondary scanning; a ribbon transporting mechanism for transporting an ink ribbon between the thermal head and the platen in the direction of secondary scanning while the ink ribbon is brought into contact with the heating elements; and a press releasing mechanism for causing the thermal head to move away from the platen against the pressing force of the head pressing mechanism. The press releasing mechanism includes a solenoid elongated in the secondary scanning direction which causes a rod to slide in the secondary scanning direction at the position corresponding to the rear surface of the thermal head; a support shaft disposed between the solenoid and the thermal head with its axis being oriented in the primary scanning direction; and a lever link attached to the support shaft in a pivotable manner. The lever link consists of a first arm and a second arm respectively extending in substantially orthogonal directions in relation to the support shaft, the first arm being connected to the solenoid and the second arm being connected to the thermal head. When the rod of the solenoid slides so that the tip of the first arm of the lever link is displaced, the thermal head connected to the tip of the second arm of the lever link departs from the platen. In other words, the sliding motion of the rod of the solenoid is transformed into the moving motion of the thermal head away from the platen by means of the lever link. The solenoid and the thermal head are longitudinally positioned in parallel to each other, whereby the area occupied by the combination of the thermal head and the solenoid is reduced. This results in reduction of the overall size of the printer.

BRIEF DESCRIPTION OF THE DRAWINGS

FIG. 6(*b*) is a side elevational view showing the pinch roller when separated from the guide roller.

BEST MODES FOR CARRYING OUT THE INVENTION

Figure 1:
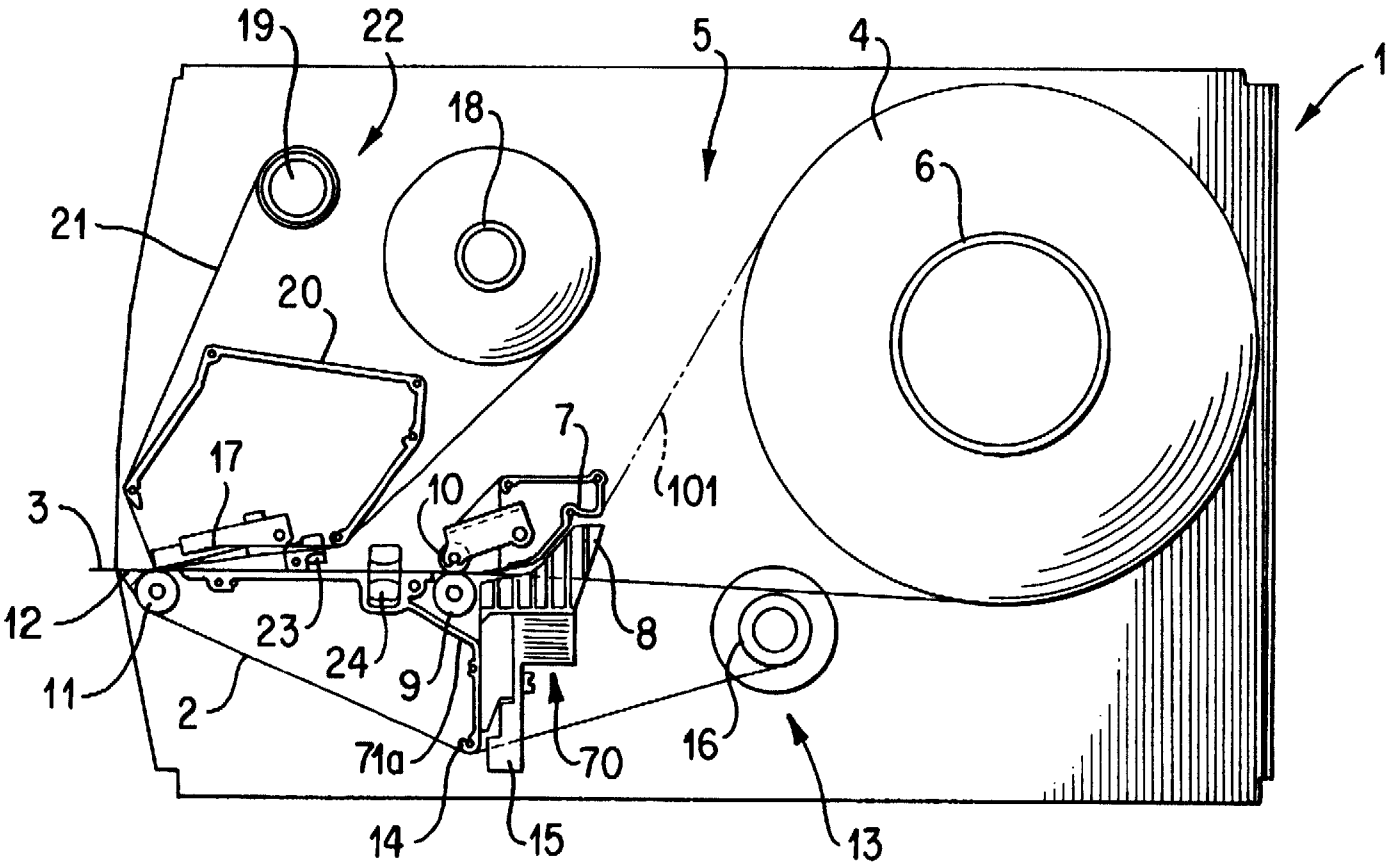
FIG. 1 is a longitudinal cross sectional view of the whole of a thermal printer showing an internal mechanism.
Figure 2:
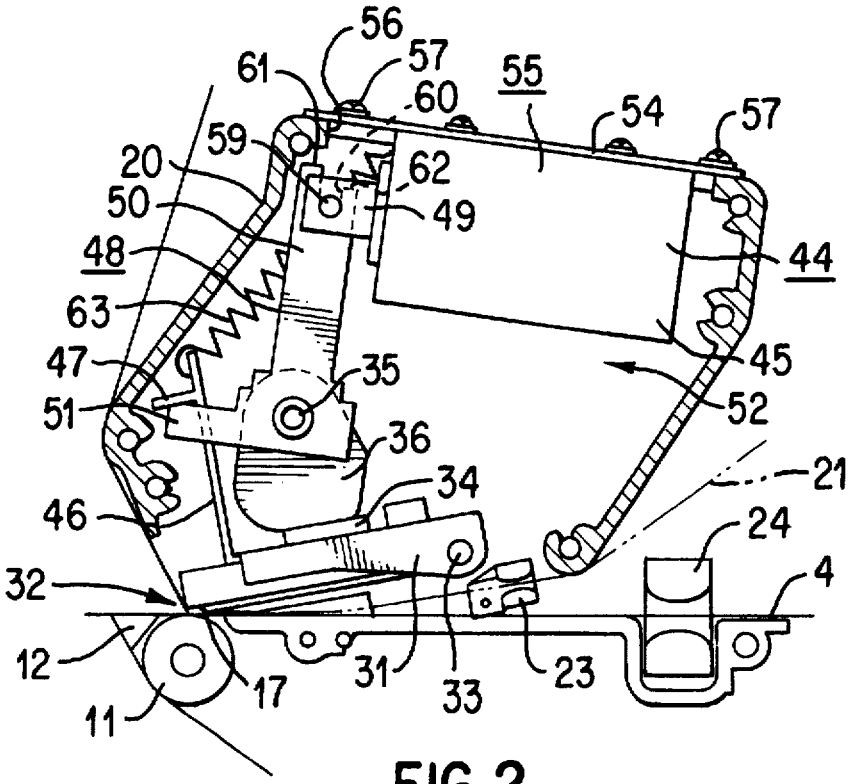
FIG. 2 is a longitudinal cross sectional view showing a mechanism for pressing a thermal head against or moving it away from a platen.

A printer in a preferred embodiment according to the present invention will now be described with reference to the accompanying drawings. This embodiment shows the application of the present invention to a label printer 1. As shown in FIG. 1, the label printer 1 is provided with a paper feeding mechanism 5 for guiding print paper to a predetermined guide path 101. FIG. 1 shows a label sheet 4 set as print paper in the paper feeding mechanism 5, the label sheet 4 comprising a plurality of labels 3 removably adhering to a backing sheet 2 having a continuous form at predetermined intervals. Although not shown in the drawing, a tag sheet, i.e., a sheet including tags, each having a black print mark as an index, arranged in rows, can be selectively set in the paper feeding mechanism. For convenience, an explanation will be given of the embodiment which uses the label sheet 4 as print paper.

FIG. 1 schematically shows the construction of the label printer 1 in this embodiment. The paper feeding mechanism 5 guides the label sheet 4 to the guide path 101, and a predetermined image is printed on the label 3 of the label sheet 4 during the travel of the label sheet 4 by transferring ink from an ink ribbon 21 to the label 3 using a thermal head 17. The label sheet 4 is sharply bent so as to peel the label 3 off from the backing sheet 2 by a peeling member 12, after the printing of the image, and the backing sheet 2 is taken up by a backing sheet take-up mechanism 13. The backing sheet 2 from which the label 3 has been peeled is guided by backing sheet guides 14 and 15 in the backing sheet take-up mechanism 13 and is finally taken up by a take-up roller 16. Each part of the label printer 1 will now be described in detail.

[PAPER FEEDING MECHANISM]

The paper feeding mechanism 5 is made up of a feed roller 6, sheet guides 7 and 8, a guide roller 9 and a pinch roller 10, and a platen roller 11 which are disposed along the guide path 101 in this order. The paper feeding mechanism 5 is driven by a stepping motor (not shown). The guide roller 9 and the platen roller 11 are supported by a main frame in a cantilevered fashion. These rollers are respectively connected to one stepping motor (not shown) by means of a drive belt and simultaneously rotated in synchronization with the rotation of the stepping motor.

Figure 6A:
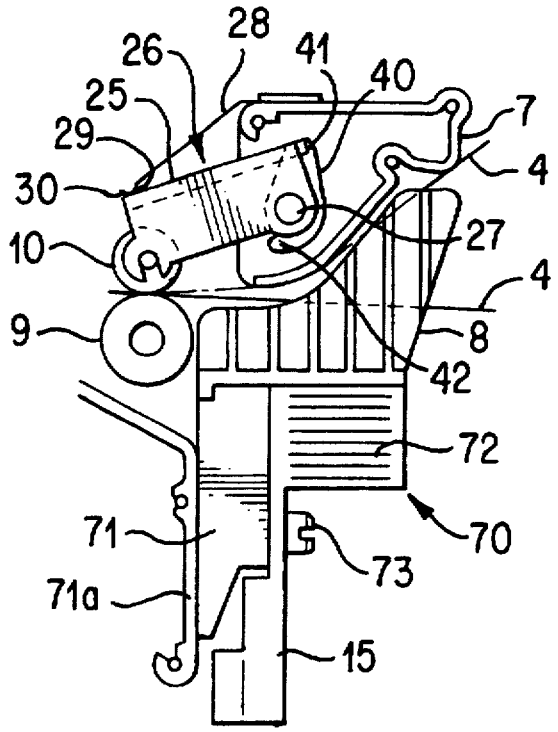
FIG. 6(*a*) is a side elevational view showing a pinch roller when pressed against a guide roller.
Figure 6B:
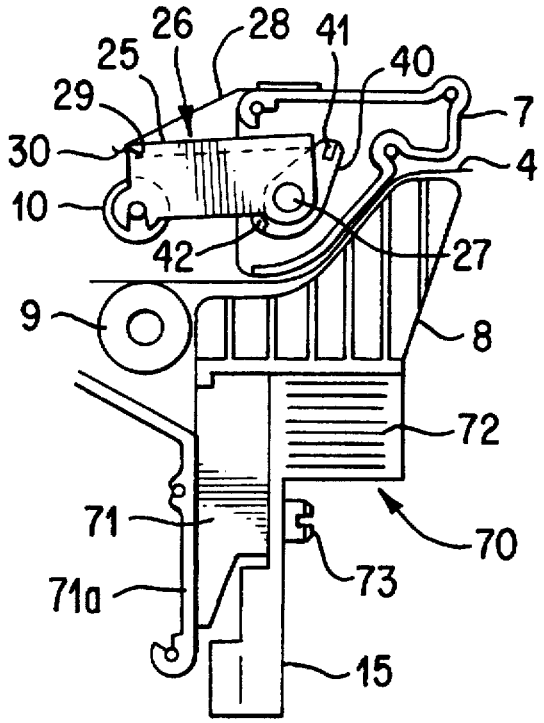
Figure 7:
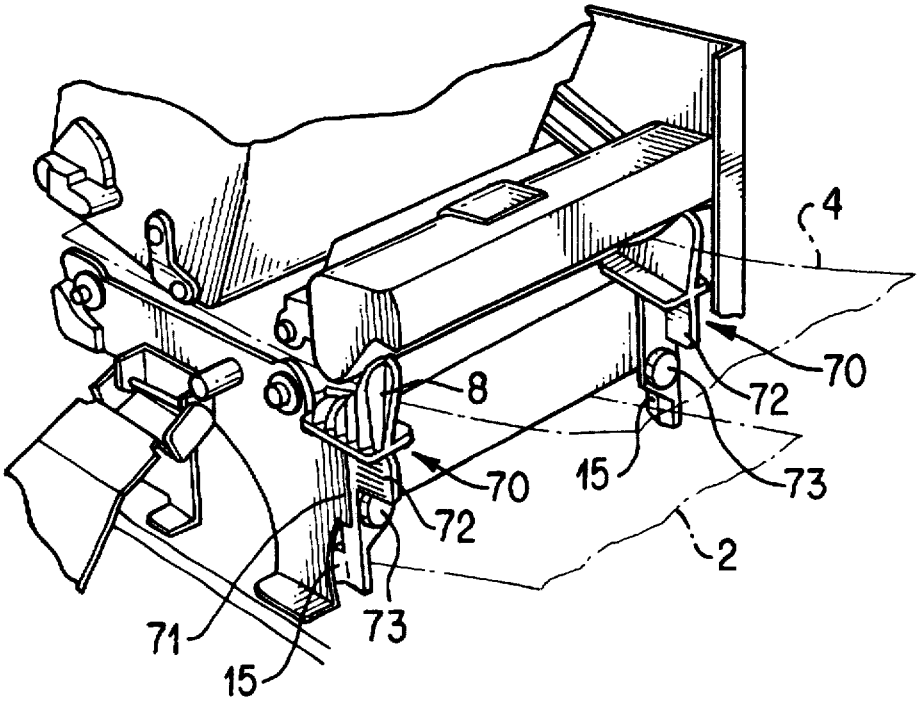
FIG. 7 is a perspective view showing a pitch control mechanism for sheet guide.

FIGS. 6(*a*) and 6(*b*) and 7 show the construction of the pair of sheet guides 8 which are parts of the paper feeding mechanism 5. These sheet guides 8 are integrally joined to the pair of backing sheet guides 15 which are parts of the backing sheet take-up mechanism 13, thereby constituting a pair of guide members 70. The pair of guide members 70 are supported by guide rails 71 by means of a known rack-and-pinion moving mechanism (not shown) in such a way as to be movable along the guide rails 71 close to or apart from the center reference level. The guide rails 71 are attached to the rear surface of an internal frame 71*a* at the bottom end of which the backing sheet guides 14 are formed. Operation knobs 72 rearwardly project respectively between the sheet guides 8 and the backing sheet guides 15 for use in shifting the guide members 70. Lock bolts 73 are provided below the operation knobs 72 for fixedly positioning the guide members 70. Specifically, the guide members 70 are shifted with the operation knobs 72 after the lock bolts 73 have been loosened. Thereafter, the guide members 70 are fixedly positioned by fastening the lock bolts 73.

Figure 5:
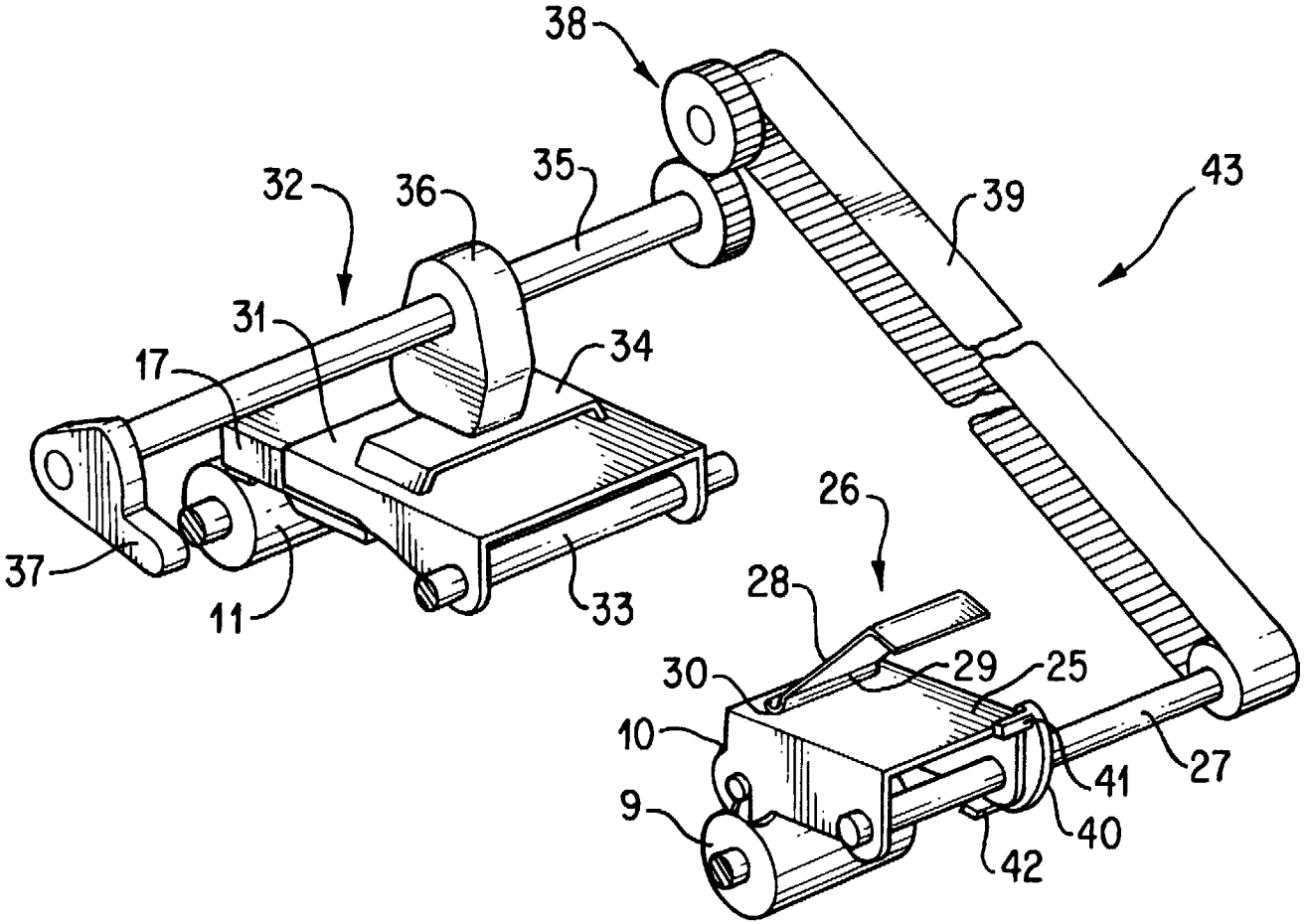
FIG. 5 is a perspective view of an opening and closing linkage.

FIGS. 5, 6(*a*) and 6(*b*) show the construction of the guide roller 9 and the pinch roller 10 which are parts of the paper feeding mechanism 5. The guide roller 9 is supported by the main frame in a rotatable fashion. The pinch roller 10 is attached to the guide roller 9 so as to be pressed against or separated from the guide roller 9. More specifically, the pinch roller 10 is rotatively supported by the tip end of a bracket 25. The rear end of this bracket 25 is pivotally supported by a rotary shaft 27 rotatively attached to the main frame. In this way, the pinch roller 10 constitutes an integrated roller unit 26 together with the bracket 25. Hence, the pinch roller 10 is pressed against or separated from the guide roller 9 according to the pivotal movement of the bracket 25 that holds the pinch roller 10. This pinch roller 10 is pressed against the guide roller 9. A leaf spring member 28 is fixed to an upper surface of the sheet guide 7 by means of machine screws or a double-coated adhesive tape (neither of which are shown in the drawing). This leaf spring member 28 affords a spring force to the upper surface of the bracket 25. By virtue of this spring force, the pinch roller 10 exerts a pressing force onto the guide roller 9. In more detail, the leaf spring member 28 has an angularly depressed portion 29 and a curvedly raised portion 30, both being provided at the tip of the leaf spring member 28. These angularly depressed and curvedly raised portions 29 and 30 are formed by bending the leaf spring member 28. The angularly depressed portion 29 engages the front edge of the bracket 25 when the guide roller 9 is separated from the pinch roller 10, and holds the roller unit 26 in that state. FIG. 6(*b*) shows this state. The curvedly raised portion 30 increases the pressing force which the leaf spring 28 exerts on the roller unit 26 when the pinch roller 10 is pressed against the guide roller 9 (see FIG. 6(*a*)).

[IMAGE FORMING MECHANISM]

An image printing mechanism chiefly consisting of the thermal head 17 will now be explained. The platen roller 11 is provided as one part of the image printing mechanism, and the thermal head 17 is pressed against or separated from the platen roller 11 with the guide path 101 sandwiched between the platen roller 11 and the thermal head 17. The thermal head 17 is pressed against the platen roller 11 by means of a head passing mechanism which will be described later. The image printing mechanism is also provided with a press releasing mechanism 52 which will be described later. This press releasing mechanism 52 prevents the thermal head 17 from being pressed against the platen roller 11.

The thermal head 17 is arranged in such a way that ink of the ink ribbon 21 is fused by selectively heating a plurality of heating elements (not shown) provided in a line with respect to print paper of the label sheet 4. A ribbon transporting mechanism 22 is disposed above the thermal head 17 for transporting the ink ribbon 21 between the heating elements (not shown) of the thermal head 17 and the label sheet 4 carried along the guide path 101. This ribbon transporting mechanism 22 is made up of a feed roller 18 for holding the ink ribbon 21 coiled around it, a take-up roller 19 for taking up the ink ribbon 21, and a guide frame 20 for guiding the ink ribbon 21 along a predetermined path. The ribbon transporting mechanism 22 is driven by a stepping motor (not shown). The guide frame 20 has functions of preventing fingers or the like from touching the thermal head 17, and the head pressing mechanism and the press releasing mechanism 52 both of which will be described later, as well as guiding the ink ribbon 21. The guide frame 20 is arranged so that these guarding functions can be implemented.

The platen roller 11, the thermal head 17, the feed roller 18, the take-up roller 19, and the guide frame 20 are supported by the main frame of the label printer 1 in a cantilevered fashion. A transmission photosensor 23 is disposed upstream in relation to the thermal head 17 for sensing the ink ribbon 21. Moreover, a photosensor 24 consisting of a transmission photosensor and a reflection photosensor in combination is arranged next to the photosensor 23 in the guide path 101 for print paper between the thermal head 17 and the guide roller 9.

[HEAD PRESSING MECHANISM]

The previously mentioned head pressing mechanism will now be described. The thermal head 17 is fitted to a bracket 31, thereby constituting a head unit 32. This head unit 32 is pivotally supported by a rotary shaft 33 supported by the main frame, and is provided with a head leaf spring 34 positioned on an upper surface of the bracket 31. Both ends of the head leaf spring 34 are held by a support section (not shown) standing on the bracket 31. A pressing cam 36 rests on the head leaf spring 34 as a pressing body fixed to a rotary shaft 35 which serves as a rotatable drive shaft. The thermal head 17 of the head unit 32 is pressed against the platen roller 11 by a pressing force developed when the pressing cam 36 comes into contact with the substantial center of the head leaf spring 34. Hence, the head pressing mechanism is principally made up of the head leaf spring 34 and the pressing cam 36.

As shown in FIG. 5, the rotary shaft 35, to which the pressing cam 36 is fixed, is rotatively supported by the main frame, and a manual operation lever 37 is fixed to one end of the rotary shaft 35. If the pressing cam 36 is pivotally moved by pivoting the rotary shaft 35 using this operation lever 37, it will be possible to separate the thermal head 17 from the platen roller 11.

[OPENING AND CLOSING LINKAGE 43]

An opening and closing linkage 43 causes the pinch roller 10 to be pressed against or separated from the guide roller 9 at the same time that the thermal head 17 is pressed against or separated from the platen roller 11. This opening and closing linkage 43 will now be described with reference to FIG. 5. The rotary shaft 27 of the roller unit 26 is linked to one end of the rotary shaft 35 which is, at the other end thereof, connected to the operation lever 37 via a train of gears 38 and a belt driving mechanism 39. A guide member 40 is fixed to this rotary shaft 27, and projections 41 and 42 of this guide member 40 mesh with the rear end portion of the bracket 25.

In more detail, when the operation lever 37 is rotated in the direction in which the thermal head 17 is separated from the platen roller 11 while they are brought into pressed contact with each other, the guide member 40 rotates in the direction opposite to the direction of the rotation of the operation lever 37 by way of the train of gears 38 and the belt driving mechanism 39. As a result of this, the projection 42 of the guide member 40 thrusts the lower surface of the rear end portion of the bracket 25 upward, and hence, the bracket 25 is raised against the pressing force of the leaf spring member 28. At this time, the angularly depressed portion 29 of the leaf spring member 28 engages with the bracket 25, so that the bracket 25 is held in a raised state. In this state, when the operation lever 37 is rotated in the direction in which the thermal head 17 is pressed against the platen roller 11, the projection 41 of the guide member 40 downwardly presses the upper surface of the rear end portion of the bracket 25, whereby the bracket 25 descends.

[PRESS RELEASING MECHANISM 52]

With reference to FIGS. 2 through 5, the press releasing mechanism 52 for releasing the thermal head 17 from its pressed contact with the platen roller 11 will be described. This press releasing mechanism 52 is principally made up of an elongated push-pull solenoid 44 disposed on an inner upper surface of the guide frame 20, and an L-shaped lever link 48 which links the rod 49 of the solenoid 44 to the thermal head 17.

The solenoid 44 is disposed above the thermal head 17 in the direction substantially parallel to the secondary scanning direction. The lever link 48 is coupled to the rod 49 of the solenoid 44. The rotary shaft 35, to which the pressing cam 36 is fixed, also acts as a support shaft for this lever link 48, and the lever link 48 is rotatively attached to the rotary shaft 35. The lever link 48 is made up of a first arm 50 whose tip end engages with the rod 49, and a second arm 51 which extends in the direction orthogonal to the first arm 50. This second arm 51 is made shorter than the first arm 50, and the tip of the second arm 51 engages with an extension arm 46 fixed to the bracket 31 of the head unit 32. This extension arm 46 orthogonally projects from the bracket 31 of the head unit 32, and a projection 47 with which the second arm 51 engages is formed at the upper end portion of the extension arm 46.

Figure 3:
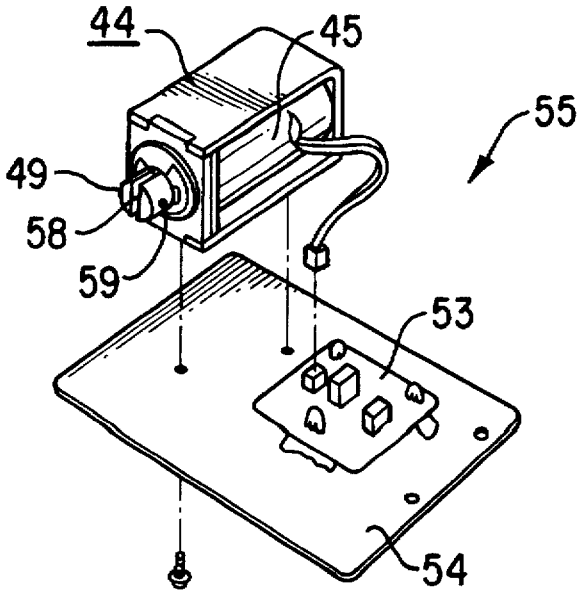
FIG. 3 is an exploded perspective view of a solenoid unit.
Figure 4:
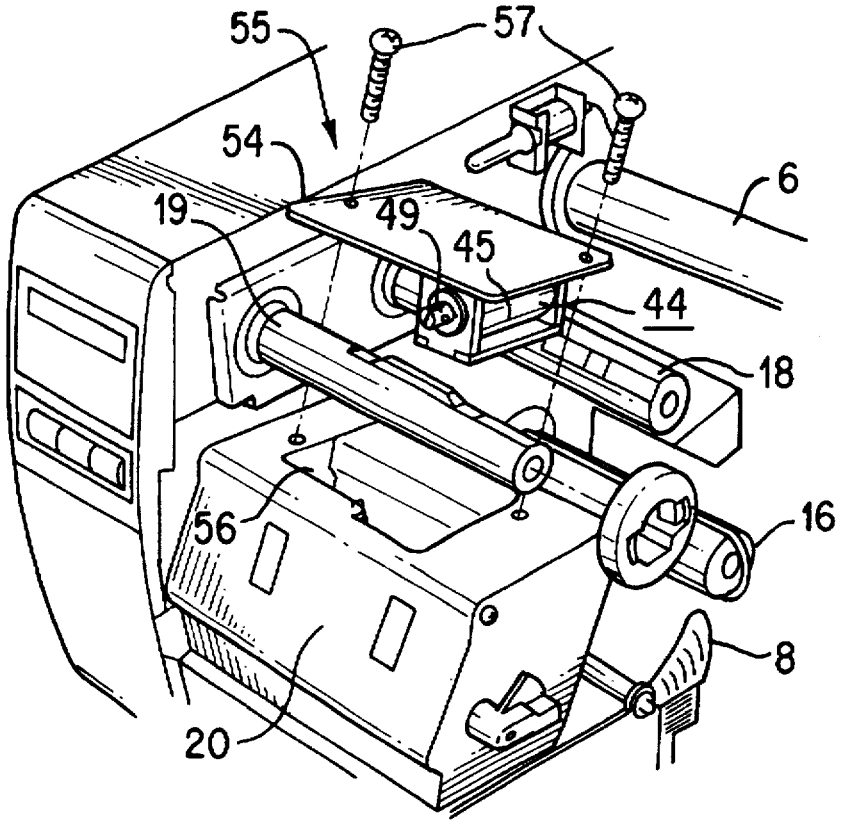
FIG. 4 is an exploded perspective view showing a mechanism for fitting the solenoid unit to a guide frame.

The attachment of the press releasing mechanism 52 to the label printer will now be described. As shown in FIG. 3, a solenoid unit 55 is constituted by the combination of a solenoid drive unit 53 with the solenoid 44 mounted on a plate 54, which is a solenoid mounting mechanism. As shown in FIG. 4, the solenoid unit 55 is screwed to an opening aperture 56 formed in the upper surface of the guide frame 20 by machine screws 57. Each part of this mechanism is arranged so that the solenoid 44 will be smoothly linked to the tip end of the first arm 50. An indentation 58 is transversely formed into the tip end of the rod 49 of the solenoid 44 to a depth that is much larger than the thickness of the first arm 50. A connection pin 59 is fitted into this indentation 58 so as to transversely pass through the same. An indentation 60 is formed between two adjacent projections 61 and 62 at the tip end of the first arm 50, and the connection pin 59 engages with this indentation 60. The tip end of the first arm 50 is situated close to the opening aperture 56 of the guide frame 20, and the projection 61 is formed longer than the other projection 62 so as to be continuous with the edge of the opening aperture 56 without actually making contact. Therefore, when a plate 54 of the solenoid unit 55 is attached to the opening aperture 56 of the guide frame 20, the tip end of the first arm 50 enters the indentation 58 of the rod 49 of the solenoid 44. The connection pin 59 of the solenoid 44 meshes with the indentation 60 formed at the tip end of the first arm 50 from the above.

A coil spring 63 is extended between the upper end portion of the extension arm 46 of the head unit 32 and the front edge of the top board of the guide frame 20. The head unit 32 is pulled under the pulling strength of the coil spring 63 in the upward direction in which the head unit 32 separates from the platen roller 11.

A detailed explanation will now be given of the operation of the embodiment whose operation has already been partially explained. The label sheet 4 is carried along the guide path 101 by the paper feeding mechanism 5. During the travel of the label sheet 4, printing of a predetermined item on the label 3, the issuance of the printed label 3, and the take-up of the backing sheet 2 are carried out. The nonillustrated heating elements of the thermal head 17 are selectively driven to be heated according to print data, in synchronization with the transfer of the label sheet 4 by means of the paper feeding mechanism 5 and the ribbon transporting mechanism 22 and the transfer of the ink ribbon 21 by means of the ribbon transporting mechanism 22. As a result, ink of the ink ribbon 21 is selectively fused and transferred to the label 3, whereby a predetermined image is printed on the label 3. The printed label 3 is peeled off from the backing sheet 2 as a result of the sharp bending of the backing sheet 2 by means of the peeling member 12, and the thus peeled label 3 is issued as a printed label 3. At this time, the backing sheet 2 is taken up by the take-up roller 16 of the backing sheet take-up mechanism 13.

It is possible for this label printer 1 in this embodiment to open the guide path 101 in order to set print paper or eliminate paper jams, and to raise the thermal head 17 while paper is being fed without accompanying printing operation. Each of these operations will now be described in detail.

[OPENING OPERATION OF GUIDE PATH 101]

The guide path 101 is opened by the separating action of the thermal head 17 and the departing action of the pinch roller 10. At this time, it is also possible to cause the pair of guide members 70 to be separated from each other after the opening of the guide path 101.

In order to raise the thermal head 17 and the pinch roller 10, the rotary shaft 35 is manually rotated counterclockwise using the operation lever 37. As a result of this, the pressing cam 36 rotates and recedes from the cam leaf spring 34. Thus, the thermal head 17 is pulled upwards by the coil spring 63 and also moves away from the thermal head 17, so that the guide path 101 is opened. However, since the thermal head 17 is pulled by the coil spring 63, it is maintained in a raised state.

Torque of the rotary shaft 34 in the counterclockwise direction is also transmitted to the rotary shaft 27 of the roller unit 26 by way of the train of gears 38 and the driving mechanism 39, whereby the guide member 40 is rotated. At this moment, the guide member 40 rotates clockwise, and the bracket 25 of the roller unit 26, which engages with the projection 42 of the guide member 40, also rotates clockwise. As a result, the pinch roller 10 moves away from the guide roller 9, and the guide path 101 is opened. At this time, the curvedly raised portion 30 of the leaf spring member 28, which presses the upper surface of the bracket 25, and the upper surface of the bracket 25 move relative to each other as the bracket 25 rotates. Then, the angularly depressed portion 29 of the leaf spring member 28 then engages with the front edge of the bracket 25. As shown in FIG. 6(*b*), the roller unit 26 is held by the angularly depressed portion 29 of the leaf spring member 28, whereby the roller unit 26 is maintained in an raised state.

Thus, since the guide path 101 is opened at the time of setting of the print paper or carrying out maintenance work, superior workability is obtained. At this time, the thermal head 17 and the roller unit 26 are maintained in their raised states, the operating efficiency of the printer is further improved. The roller unit 26 is maintained in its raised state only by the use of the angularly depressed portion 29 formed in the existing leaf spring member 28 without the necessity of a special mechanism such as a ratchet. Improved operability is implemented only by means of a simple mechanism without an increase in the number of parts.

To make the opened guide path 101 return to its original state, the rotation shaft 35 is rotated clockwise by manually operating the operation lever 37. As a result of this, the cam leaf spring 34 is pressed by the pressing cam 36, so that the thermal head 17 is pressed against the platen roller 11. The projection 41 of the guide member 40 rotates the bracket 25 of the roller unit 26 counterclockwise, whereby the curvedly raised portion 30 of the leaf spring member 28 presses the bracket 25, and the pinch roller 10 is pressed against the guide roller 9.

[CONTROL OPERATION FOR PITCH BETWEEN THE PAIR OF GUIDE MEMBERS 70]

The label sheet 4 carried by the label feed mechanism 5 is guided by the pair of sheet guides 8, and the backing sheet 2 to be taken up by the backing sheet take-up mechanism 13 is guided by the pair of backing sheet guides 15. These sheet guides 8 and the backing sheet guides 15 can be set so as to come close to or apart from each other, and hence, the sheet guides can cope with various types of label sheet 4. Moreover, the sheet guides 8 and the backing sheet guides 15 are integrated together as the pair of guide members 25. For this reason, it is unnecessary to respectively adjust the positions of the sheet guides 8 and the backing sheet guides 15, and the adjustment of the guides is simple, thereby resulting in improved working efficiency. Further, the paper feeding mechanism 5 and the backing sheet take-up mechanism 13 are disposed adjacent to each other. Hence, the area of the space occupied by the guide member is not increased even when the sheet guides 8 and the backing sheet guides 15 are integrated together, which prevents the printer from being increased in size.

[RAISING OPERATION OF THERMAL HEAD 17]

The label sheet 4 is often fed without printing images. Feeding of the ink ribbon 21 in such a case results in wastage of the ribbon. To avoid this, the wastage of the ink ribbon 21 is prevented by raising the thermal head 17.

To raise the thermal head 17, the solenoid 44 is energized. Then, the rod 49 is then drawn into the inside of the solenoid main body 45, and the upper end portion of the first arm 50 connected to this rod 49 rotates in a clockwise direction in FIG. 2. According to this, the second arm 51 also rotates clockwise, so that the extension arm 46 is pushed upward by the second arm 51. As a result, the thermal head 17 of the head unit 32 is raised against the pressing force of the cam leaf spring 34 and is slightly spaced apart from the platen roller 11. The amount of the separation is the extent to which the ink ribbon 21 does not move as a result of friction between the ribbon 21 and the label sheet 4, and that amount is smaller than the amount of separation resulting from the rotation of the operation lever 37.

When carrying out this raising operation of the thermal head 17, the drive torque of the solenoid 44 is amplified by a ratio of the length of the first arm 50 to the length of the second arm 51 by virtue of basic lever action. For this reason, even if the solenoid 44 having small drive torque is used, it is possible to sufficiently raise the thermal head 17. Moreover, the lever link 48 deflects the direction in which a stress acts substantially at right angles, and hence the solenoid 44 is disposed substantially in parallel to the secondary scanning direction. Therefore, it becomes unnecessary to stand a large solenoid upright above the front edge portion of the thermal head 17 in the direction orthogonal to the secondary scanning direction. Thus, it is possible to reduce the overall size and weight of the printer.

In this embodiment, the solenoid 44 and its drive circuit 53 are mounted together on the plate 54, thereby constituting the solenoid unit 55. Hence, it is possible to carry out the attachment or replacement of the solenoid 44 and its drive circuit 53 in each solenoid unit 55, thereby resulting in improved maintainability and productivity. Further, it is possible to make the solenoid unit 55 optional for the label printer 1.

When the solenoid unit 55 is attached to the printer, the connection pin 59 attached to the rod 49 of the solenoid 44 is fitted into the recess 60 formed in the tip portion of the first arm 50 of the lever link 48. Then, the solenoid unit 55 is then attached to the opening aperture 56 of the guide frame 20, and the solenoid unit is fixed by the machine screws 57. At this time, the two projections 61 and 62 constituting the recess 60 of the first arm 50 are relatively positioned such that the projection 62 closer to the solenoid 44 is shorter than the other projection 61 farther from the solenoid 44. Hence, it is easy to fit the connection pin 59 of the rod 49 into the recess 60 of the first arm 50. In addition, the rear surface of the projection 61, serving as the front inner surface of the recess 60 of the first arm 50, is continuous to the front edge portion of the opening aperture 56, and therefore, the connection pin 59 of the rod 49 does not enter between the lever link 48 and the guide frame 20, thereby resulting in considerably superior operability.

The rotation shaft 35 acts not only as the support shaft for supporting the lever link 48 of the press releasing mechanism 52 but also as the drive shaft of the pressing cam 36. This leads to the reduced number of parts, and a light-weight printer having a small overall size, as well as improved productivity, thereby resulting in improved productivity.

What is claimed is:

1. A thermal printer comprising:

a platen;

a thermal head which is pressed against or separated from said platen, said thermal head having a rear surface and including a plurality of heating elements arranged at a part thereof which comes into contact with said platen;

a head pressing mechanism which presses said thermal head against said platen;

a paper feeding mechanism for feeding print paper between said thermal head and said platen in a secondary scanning direction;

a ribbon transporting mechanism for transporting an ink ribbon between said thermal head and said platen in the secondary scanning direction while the ink ribbon is brought into contact with the heating elements; and a press releasing mechanism for causing said thermal head to move away from said platen against a pressing force of said head pressing mechanism, wherein said press releasing mechanism includes a solenoid elongated in the secondary scanning direction which slides a rod in the secondary scanning direction at a position opposing to the rear surface of said thermal head, a support shaft disposed between said solenoid and said thermal head, said support shaft being oriented in a primary scanning direction, and a lever link which is pivotally attached to said support shaft and is made up of a first arm and a second arm both of which extend in directions substantially orthogonal to said support shaft, said first arm being coupled to the rod of said solenoid and said second arm being coupled to said thermal head, wherein a recess is formed on a tip of said first arm of said lever link, and a connection pin to be fitted into said recess is formed on said rod of said solenoid, wherein said second arm of said lever link extends in said secondary scanning direction in relation to said support shaft.

2. The thermal printer according to claim 1, wherein said first arm of said lever link is longer than said second arm.

3. The thermal printer according to claim 1, wherein a first projection and a second projection constitute said recess of said first arm, said first projection being located further away from the rod of said solenoid and formed longer than said second projection.

4. The thermal printer according to claim 1 further comprising a guide frame for covering a rear side of said thermal head having an ink ribbon guide, wherein said solenoid is attached to said guide frame.

5. The thermal printer according to claim 4, wherein an opening aperture is formed on an upper surface of said guide frame, and said solenoid is assembled into a solenoid unit to be fitted into said opening aperture.

6. The thermal printer according to claim 5, wherein a first projection and a second projection constitute said recess of said first arm, said first projection being located further away from the rod of said solenoid and formed longer than said second projection.

7. The thermal printer according to claim 6, wherein said first projection of said first arm is disposed so as to be continuous with an edge of said opening aperture of said guide frame.

8. The thermal printer according to claim 1, wherein said head pressing mechanism comprises a head leaf spring attached to the rear surface of said thermal head, and a pressing body for pressing said head leaf spring while said thermal head is brought into contact with said platen.

9. The thermal printer according to claim 8, wherein said pressing body is a pressing cam which comes into contact with or moves away from said head leaf spring when rotated.

10. The thermal printer according to claim 9, wherein a drive shaft of said pressing cam also serves as a support shaft of said press releasing mechanism.

11. The thermal printer according to claim 9, wherein said paper feeding mechanism comprises a guide roller disposed in a print paper guide path in relation to a print position, and a pinch roller which comes into contact with or moves away from said guide roller via said guide path, and said paper feeding mechanism further includes an opening and a closing linkage which causes said pinch roller to be pressed against or moved away from said guide roller at the same time that said thermal head is pressed against or moves away from said platen.

12. The thermal printer according to claim 11, wherein a leaf spring member is used as a means for affording a force to press said pinch roller against said guide roller, and said leaf spring member has a retaining portion which removably engages with a holding portion of said pinch roller moved away from said guide roller.

13. The thermal printer according to claim 12, wherein said holding portion of said leaf spring member is formed by partly curving said leaf spring member.

* * * * *